US006590176B2

(12) United States Patent
Cole et al.

(10) Patent No.: US 6,590,176 B2
(45) Date of Patent: Jul. 8, 2003

(54) PUSH-BUTTON TYPE ELECTRICAL SWITCH

(76) Inventors: Joseph W. Cole, 7221 Sandy Plains Ave., Las Vegas, NV (US) 89131; Oliver C. Mou, 9764 Trail Rider Dr., Las Vegas, NV (US) 89117

( * ) Notice: Subject to any disclaimer, the term of this patent is extended or adjusted under 35 U.S.C. 154(b) by 0 days.

(21) Appl. No.: 09/804,701

(22) Filed: Mar. 12, 2001

(65) Prior Publication Data

US 2002/0125119 A1 Sep. 12, 2002

(51) Int. Cl.[7] ..... H01H 9/00
(52) U.S. Cl. ..... 200/341; 200/310
(58) Field of Search ..... 200/341, 308, 200/310, 317, 329, 332.1, 296

(56) References Cited

U.S. PATENT DOCUMENTS

| | | | | |
|---|---|---|---|---|
| 3,740,501 A | | 6/1973 | Kiessling et al. | |
| 3,895,205 A | | 7/1975 | Tharp | |
| 3,983,348 A | | 9/1976 | Kellogg | |
| 4,354,078 A | | 10/1982 | Yoshimura | |
| 4,360,722 A | | 11/1982 | Georgopulos | |
| 4,368,368 A | * | 1/1983 | Russenberger | 200/153 J |
| 4,419,555 A | | 12/1983 | Kim | |
| 4,454,397 A | | 6/1984 | Kim | |
| 4,585,914 A | * | 4/1986 | Ohashi et al. | 200/284 |
| 4,590,342 A | * | 5/1986 | Schlegel | 200/159 B |
| 4,733,036 A | | 3/1988 | Koizumi et al. | |
| 4,871,890 A | | 10/1989 | Herrera | |
| 5,077,454 A | | 12/1991 | Lorenzo | |
| 5,178,504 A | * | 1/1993 | Falchi | 411/553 |
| 5,401,925 A | * | 3/1995 | Sambar | 200/296 |
| 5,543,594 A | | 8/1996 | Romero-Herrera | |
| 6,066,816 A | * | 5/2000 | Benger | 200/296 |
| 6,166,339 A | * | 12/2000 | Bechis | 200/61.45 R |

* cited by examiner

*Primary Examiner*—Elvin Enad
*Assistant Examiner*—Lisa Klaus
(74) *Attorney, Agent, or Firm*—Weide & Miller, Ltd.

(57) ABSTRACT

A push-button actuatable electrical switch is disclosed. In one embodiment, the push-button electrical switch includes a body having a first end and a second end, an actuator associated with the body, a push-button lens cap mounted to the actuator and extending from the first end of said body, an electrical switch having a switch button for activating the switch, and a mount adapted to support a lamp and the electrical switch. In one embodiment, the body includes a latch extending outwardly from the bottom end of the body in a direction generally opposite the top end and the mount includes a surface for engagement by the latch for connecting the mount to the body in position such that movement of the actuator with the push-button lens cap causes the switch button to be activated. In one embodiment, at least a portion of the body adjacent the push-button lens cap is transparent and illuminated by the lamp. In another embodiment, an electrically conductive pathway is defined through the body to a support structure whereby electrical discharges are routed to ground rather than through the lamp and electrical switch.

5 Claims, 4 Drawing Sheets

PUSH-BUTTON TYPE ELECTRICAL SWITCH

FIELD OF THE INVENTION

The present invention relates to electrical switches, and more particularly to a push-button type electrical switch.

BACKGROUND OF THE INVENTION

Push-button type switches are utilized in thousands of applications. One common application for push-button switches is as an input device for a gaming machine. For example, a gaming machine may include a plurality of push-buttons permitting a user to indicate a input, such as to "hold" a card, place a "bet" of a monetary amount, "deal" cards or the like.

In the gaming machine environment, the push-buttons are generally mounted to a portion of the gaming machine housing, such as a metal panel. One problem with these buttons is that they are subject to electrostatic discharge (ESD). A user of the machine may carry an electric charge, such as developed by walking across carpeting in a casino. When the user touches a button of the gaming machine, the path to ground through the button is through the electrical circuitry thereof, including the switch. Thus, the ESD is released through the circuitry of the button. This discharge may harm the switch of the button and may even travel through the gaming machine circuitry to a controller, such as a gaming machine processor. The discharge may damage this circuitry or interfere with the operating of the game for a short period of time. In either event, the discharge causes harm.

During the lifetime of the gaming machine, the buttons of the machine may be used tens of thousands of times. It is therefore important to provide a push-button switch which will accept a high duty cycle and has a long-life. Among other things, components of a button may need to be replaced in order to maintain the button, or else the entire button must be replaced.

In many instances, gaming machines are located in areas of reduced illumination. The reduced illumination makes it easier for a player of the game to view information presented on a video display of the gaming machine. On the other hand, the reduced illumination makes it difficult for a player to observe other aspects of the gaming machine, such as the location of push-buttons. It is desirable to provide a button which is easy to see and use.

SUMMARY OF THE INVENTION

The present invention is a push-button actuatable electrical switch.

In one embodiment, the push-button electrical switch includes a body having a first end and a second end. An actuator is associated with the body. A push-button is mounted to the actuator and extends from the first end of said body. An electrical switch is provided having a switch button for activating the switch. A mount is adapted to support a lamp and the electrical switch. The mount is connected to the body.

In one embodiment, the body includes at least one latch extending outwardly from the bottom end of the body in a direction generally opposite the top end. The mount includes a surface for engagement by the at least one latch for connecting the mount to the body in position such that movement of the actuator with the push-button causes said switch button to be activated.

In one embodiment, two latches extend outwardly from stop segments located in an interior area of the body at its bottom end. The mount includes a passage through which one of the latches extends, and a recessed or cut-away area along which the other latch extends. The latches both include catches which engage a bottom surface of a main portion of the mount when the mount is engaged with the body. The latches are moveable to a position in which the catches are released, allowing the mount to be disconnected from the body, such as for replacement of the lamp.

In one embodiment, at least a portion of the body adjacent the push-button is transparent and illuminated by the lamp. In one embodiment, the body includes a wall defining a cavity at its top end. The push-button is located at least partially in the cavity. The wall includes a flange which extends outwardly from the push-button, this flange being illuminated. In one embodiment, the lamp is located in an interior portion of the body. The entire body is transparent, transmitting light emitted by the lamp, including to the areas of the body adjacent the push-button.

In another embodiment, an electrically conductive pathway is defined through the body to a support structure whereby electrical dischargers are routed to ground rather than through the lamp and electrical switch. In one embodiment, the conductive pathway is defined by conductive material in or on the body. The conductive material may comprise conductive carbon particles embedded in plastic forming the body. In one embodiment, the pathway is defined through other portions of the body, such as an adapter or lock nut connected to the body and in contact with a support surface to which the push-button actuatable electrical switch is mounted.

Further objects, features, and advantages of the present invention over the prior art will become apparent from the detailed description of the drawings which follows, when considered with the attached figures.

DESCRIPTION OF THE DRAWINGS

FIG. 3(*b*) is a perspective view of the body of the push-button electrical switch looking in a direction from a bottom end towards a top end thereof;

DETAILED DESCRIPTION OF THE INVENTION

Figure 1:
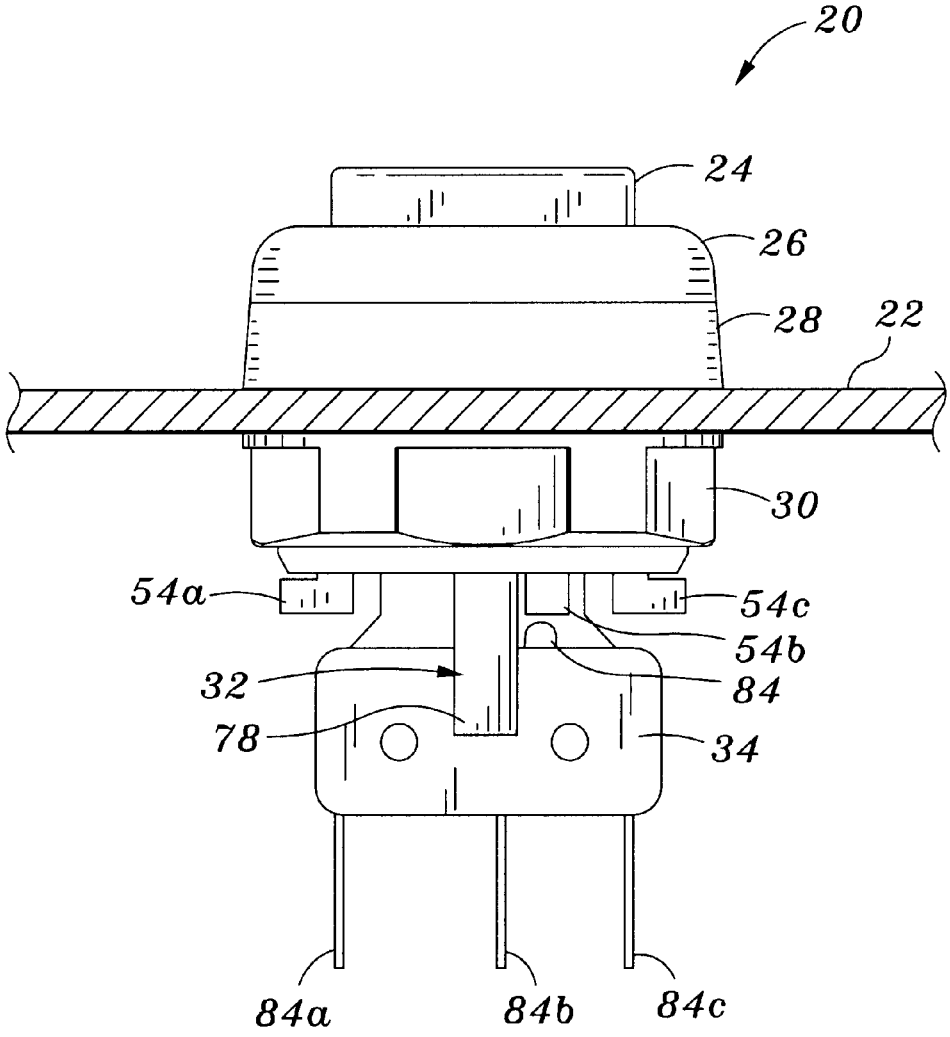
FIG. 1 is a side view of a push-button electrical switch of the invention mounted to a support structure in the form of a gaming machine housing.

The invention is a push-button type electrical switch. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, the invention is a push-button type electrical switch. The switch includes a push-button for actuating an electrical switch. In one embodiment, the push-button electrical switch has a light or lamp for illuminating a portion of a body or housing of the push-button electrical switch adjacent at least a portion of the push-button, thereby permitting easy identification of the location of the push-button by a user. In one embodiment, the push-button electrical switch has a configuration which promotes ease of assembly and disassembly. In one embodiment, the switch has one or more conductive body portions for transmitting electric discharges there through to a remote location, such as a supporting structure to which the body is mounted.

A push-button electrical switch 20 of the invention will first be described generally with reference to FIG. 1. As illustrated, the push-button electrical switch 20 may be mounted to a support structure. As illustrated, the push-button electrical switch 20 is mounted to a panel or housing 22 of a gaining machine. In general, the push-button electrical switch 20 includes a push-button lens cap 24 extending from a top portion or end of a button body or housing 26. An adapter 28 and lock nut 30 are associated with an exterior portion of the body 26. A lamp/switch mount 32 is connected to the body 26 and extends from a bottom portion or end thereof generally opposite the push-button tens cap 24. An electrical switch 34 is connected to the lamp/switch mount 32.

In the arrangement illustrated, the housing 22 comprises a metal panel forming a portion of a body or housing of the gaming machine. The housing 22 has an aperture there through. Preferably, the body 26 extends through the aperture. The aperture is larger than the portion of the body 26 which extends there through, but smaller in dimension that the adapter 28. The adapter 28 is positioned over the body 26 adjacent a top side of the housing 22, obscuring the aperture through which the body extends. The lock nut 30 is affixed to the body 26 from the bottom side of the housing 22. In this manner, the housing 22 is positioned between the adapter 28 and the lock nut 30, securing the push-button electrical switch 20 to the housing 22.

As detailed below, the push-button lens cap 24 extends outwardly from the body 26 for engagement by a user thereof, such as by a player of the gaming machine. When depressed or pushed by a user, the push-button lens cap 24 is arranged to activate/actuate the electrical switch 34. Leads extend from the electrical switch 34, and wires may be connected to the leads and extend to another device, whereby the signal from the electrical switch 34 is used as an input to that device.

Figure 2:
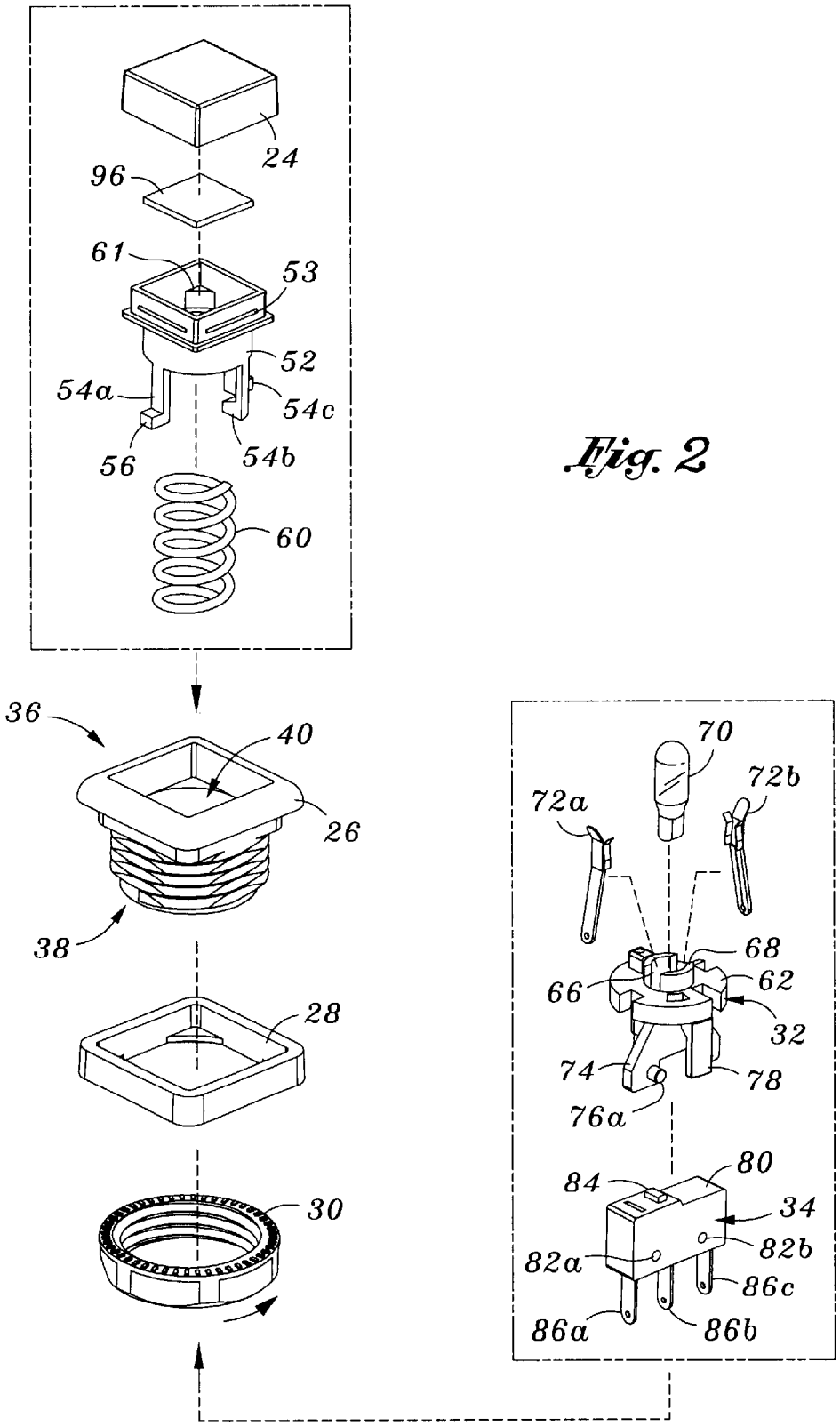
FIG. 2 is an exploded view of the push-button electrical switch illustrated in FIG. 1.

The components and construction of the push-button electrical switch 20 will now be described in detail. As illustrated in FIG. 2, the body 26 serves a supporting/housing function and includes a wall having inner and outer surfaces. In one embodiment, the body 26 is generally tubular and has a top or proximal end 36 and a bottom or distal end 38. A passage 40 extends through the body 26. As illustrated, at its top end 36, the body 26 is generally square, thus defining a generally square periphery of the passage 40. The body 26 may have a variety of other shapes at this location, such as round or rectangular. Preferably, the bottom end of 38 of the body 26 is generally cylindrical, thus defining a generally circular periphery of the passage 40 at that location.

In one or more embodiments, an outer surface of the body 26 is threaded at its bottom end 38. The threads extend upwardly towards the top end 36. The threads are adapted to accept mating threads on the lock nut 30.

Figure 3A:
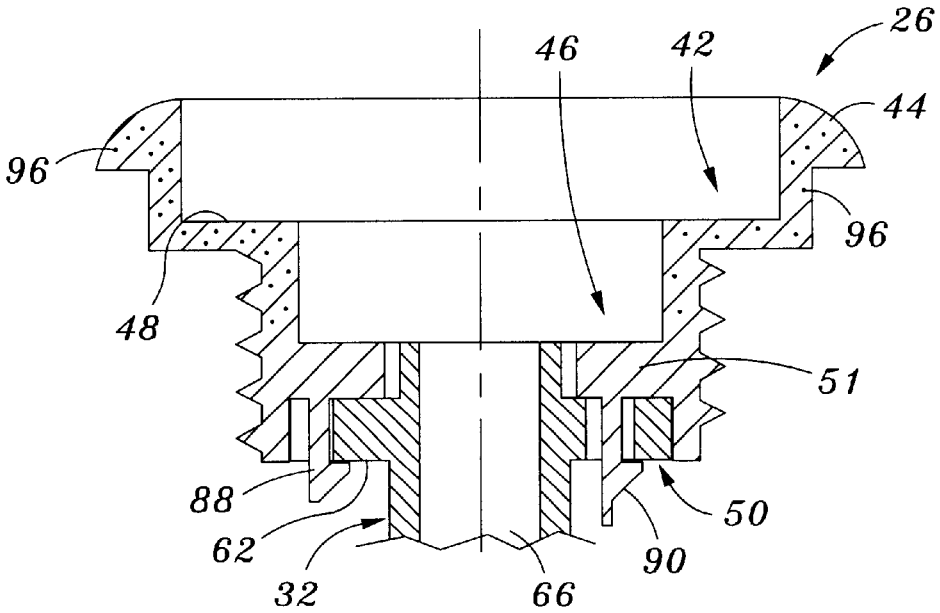
FIG. 3(*a*) is a cross-sectional view of a body of the push-button electrical switch illustrated in FIG. 1 along with a portion of an engaged lamp/switch mount connected thereto.
Figure 3B:
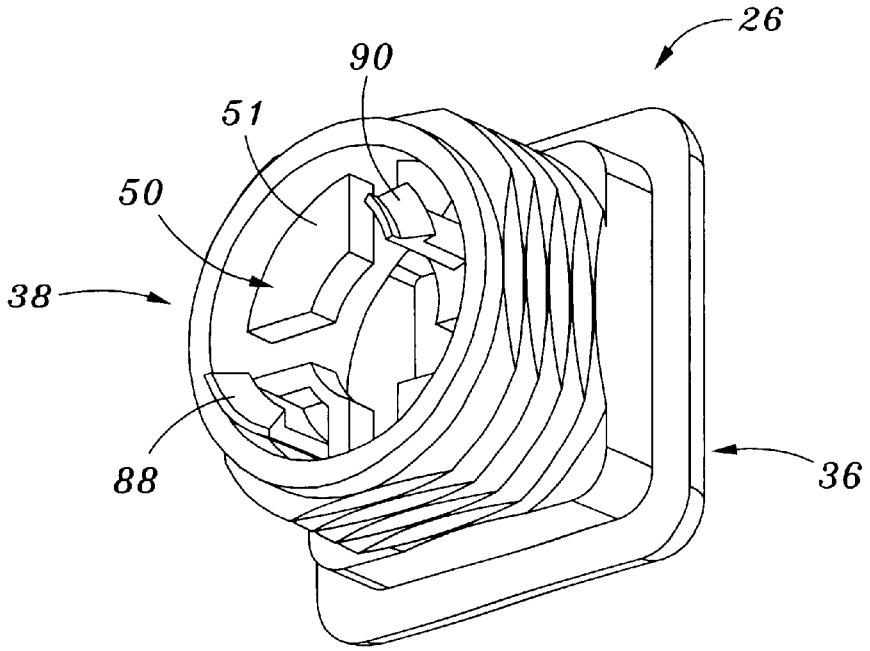

Referring to FIGS. 3(*a*) and 3(*b*), the body 26 defines an upper cavity 42 for accepting at least a portion of the push-button lens cap 24. The upper cavity 42 forms a portion of the passage 40 through the body 26. As illustrated, when the push-button lens cap 24 is generally square in peripheral shape, so is the upper cavity 42. As described above, the body 26 defines a periphery around the upper cavity 42 which is also generally square. As illustrated, the body 26 includes an outwardly extending flange 44 in this location. As noted above, the push-button lens cap 24 may be other than square, in which case the body 26 at this location is as well, for example round or rectangular.

A middle cavity 46 is positioned below the upper cavity 42 and also forms a portion of the passage 40. The middle cavity 46 is preferably cylindrical in shape, and has a diameter which is less than the maximum dimension of the upper cavity 42. As a result of the change in size and shape between the upper and middle cavities 42,46, a ledge 48 is defined. As detailed below, the ledge 48 serves as a stop to limit the travel of the push-button lens cap 24 downwardly into the body 26, and serves as a support for a spring.

A lower cavity 50 is positioned below the middle cavity 46 and also forms a portion of the passage 40. The lower cavity 50 is also preferably generally cylindrical in shape. As illustrated, a stop extends inwardly dividing at least a portion of the middle and lower cavities 46,50. Referring to FIG. 3(*b*), the stop comprises four wall or stop segments 51.

As described above, a push-button lens cap 24 is associated with the body 26, and preferably is located at the top end 36 thereof. At least a portion of the push-button lens cap 24 is adapted to extend from the top end 36 of the body 26 for engagement by a user. Referring to FIG. 2, the push-button lens cap 24 comprises a generally square member having a top surface and one or more sides or members extending downwardly therefrom. The push-button lens cap 24 may have a variety of other shapes, including rectangular and circular.

The push-button lens cap 24 is associated with an actuator 52. The actuator 52 has a first end shaped to accept the push-button lens cap 24 there over. When the push-button lens cap 24 is square, preferably so is the first end of the actuator. Likewise, when the push-button lens cap 24 has other shapes such as rectangular or circular, the first end of the actuator 52 may be as well. Notably, the first end of the actuator 52 and the push-button lens cap 24 need not be the same shape, as long as the connecting function between the two is facilitated. As illustrated, one or more tabs 53 are located on the outside of the first end of the actuator 52 for use in securing the push-button lens cap 24 to the actuator 52.

The actuator 52 has a generally cylindrical main portion adapted to fit within the middle cavity 46 of the body 26. Preferably, three legs 54*a,b,c,* extend downwardly from the periphery of the main portion of the actuator 52 in a direction opposite its first end. A pair of the legs 54*a*,54*c* are preferably located about 180 degrees apart. The third leg 54*b* is positioned there between. As illustrated, the third leg 54*b* is preferably located nearer one of the legs 54*c* than the other of the legs 54*a*.

The opposing legs 54*a*,54*c* each have a catch 56 extending outwardly therefrom. Preferably, each catch 56 extends in a direction generally radially out in a direction perpendicular to an axis extending through the actuator. Referring to FIG. 1, when the actuator 52 is positioned in the body 26, the legs 54*a,b,c,* extend through spaces between the stop segments 51 of the body 26. When so positioned, the catches 56 engage a lower rim of the body 26, preventing further upward movement of the actuator 52.

A foot 58 is located on the end of the third leg 54*b*. As described in more detail below, lie foot 58 is adapted to engage a button of the electrical switch 34 for actuating the switch. As illustrated, the Riot 58 extends radially inward from the third leg 54*b*.

A spring 60 is positioned inside of the body 26 and engages both the body 26 and the actuator 52. In a preferred embodiment, the spring 60 is a helical spring. A first end of the spring 60 rests against the top surface of the stop segments 51 of the body 26. The second end of the spring 60 is positioned within the actuator 52 and rests against a stop 61 therein. So arranged, the spring 60 has the natural tendency to urge the actuator 52 upwardly to the point where further upward travel is limited by the catches 56. The urging of the actuator 52 upwardly also urges the push-button lens cap 24 attached thereto upwardly. When pressed by a user, the push-button lens cap 24 moves the actuator 52 downwardly against the biasing force of the spring 60, compressing the spring.

Figure 4:
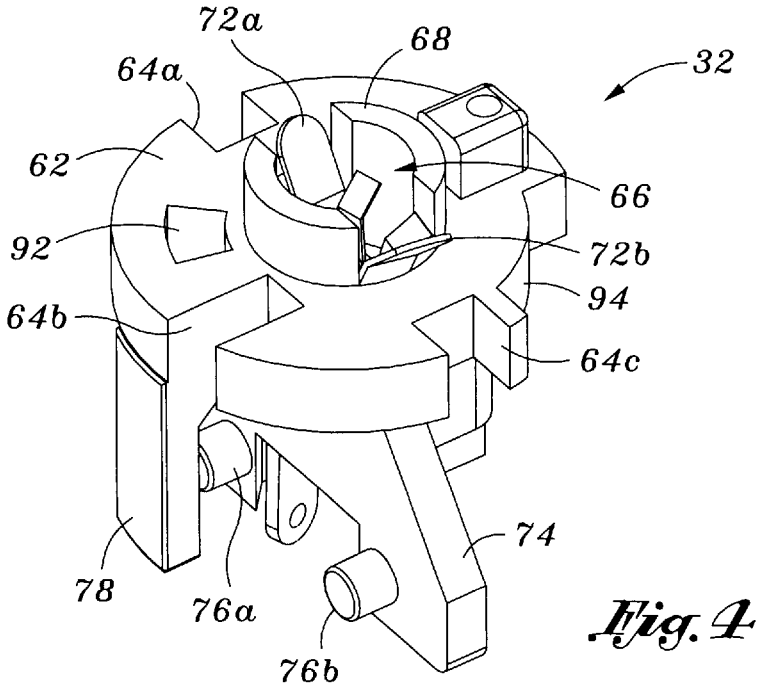
FIG. 4 is a perspective view of a lamp/switch mount of the push-button electrical switch of the invention.

The lamp/switch mount 32 is connected to the body 26 at its bottom end 38. The lamp/switch mount 32 will now be described in detail with reference to FIG. 4. The lamp/switch mount 32 has a generally disc-shaped main portion 62. The main portion 62 has three cut-out areas 64*a,b,c* permitting passage of the legs 54*a,b,c* of the actuator 52 there through.

A passage 66 extends generally centrally through (i.e. along a central axis extending generally perpendicular to a plane in which the main portion 62 extends) the main portion 62. A lamp stand 68 extends upwardly from a top surface of the main portion 62 and downwardly from a lower surface of the main portion, defining a generally lower closed end. In general, the lamp stand 68 forms extended portions of the passage 66 for accepting therein a lamp 70 (see FIG. 2). First and second contacts 72*a,b* are also located in the passage 66. The first and second contacts 72*a,b* contact leads or contacts on the lamp 70. The contacts 72*a,b* extend through the lower closed end of the lamp stand 68 for connection to appropriate power wires for powering the lamp.

A switch mount 74 extends below the main portion 62 of the lamp/switch mount 32. The switch mount 74 is offset from the central axis. In one embodiment, the switch mount 74 extends from the lamp stand 68. The switch mount 74 includes first and second spaced pins 76*a,b*. A lock 78 extends downwardly from the main portion 62. The lock 78 is spaced apart from the pins 76*a,b,* defining a space in which the electrical switch 34 may be located.

Referring to FIG. 2, the electrical switch 34 has a generally closed housing 80. The electrical switch 34 may have a variety of shapes and configurations. As illustrated, the housing 80 is generally rectangular. First and second passages 82*a*,82*b* extend through the housing 80 from side to side. The passages 82*a,b* are adapted to accept the first and second pins 76*a*,76*b* of the lamp/switch mount 32.

A button 84 extends upwardly from a top surface of the housing 80. The button 84 preferably actuates an electrical switch within the electrical switch 34. In one embodiment, the electrical switch 34 is a two-position switch. The workings of such electrical switches 34 are well known. As is common in such a two-position electrical switch 34, the electrical switch 34 includes three leads or contacts 86*a,b,c*. The position of the electrical switch 34 determines which of the leads are "hot" (one being for ground).

Figure 5:
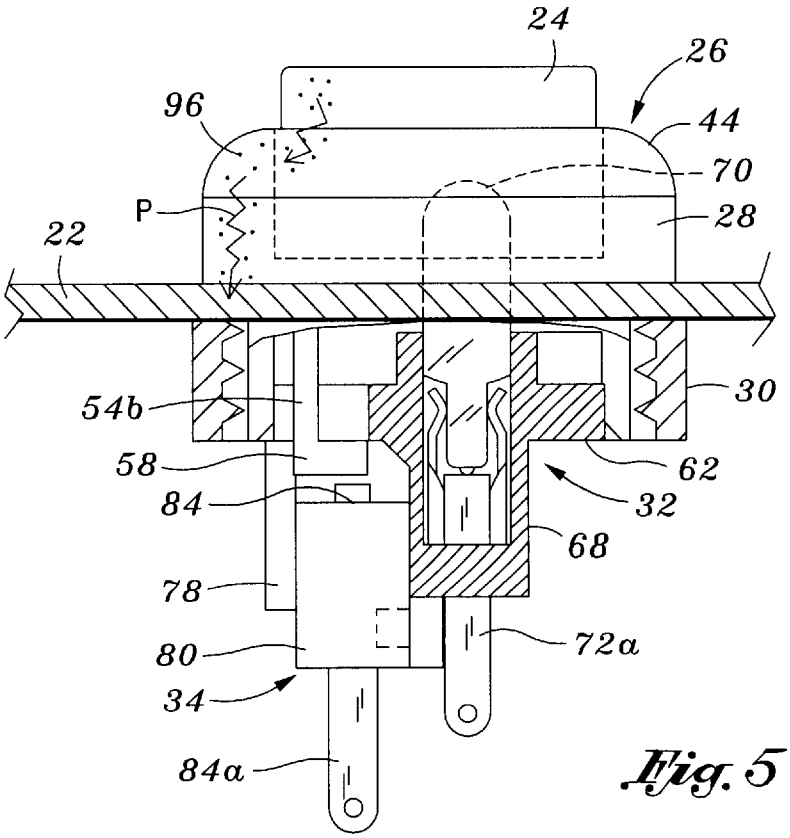
FIG. 5 is a cross-sectional view of the push-button electrical switch illustrated in FIG. 1 taken along a plane perpendicular to the support structure.

Referring to FIG. 5, when the electrical switch 34 is mounted to the lamp/switch mount 32 the pins 76*a,b* extend into the passages 82*a,b*. The lock 78 presses against the opposite side of the housing 80 of the electrical switch 34, maintaining the pins 76*a,b* in engagement with the passages 82*a,b,* securely mounting the electrical switch 34.

When so mounted, the foot 58 of the second leg 54*b* of the actuator 52 is positioned adjacent the button 84 of the electrical switch 34. When a user depresses the push-button lens cap 24, the actuator is moved downwardly, causing the foot 58 to engage the switch button 84. This actuates the electrical switch 34.

Most importantly, in accordance with the invention there is provided an advantageous mounting arrangement for removably connecting the lamp/switch mount 32 to the body 26. Referring to FIGS. 3(*a*) and 3(*b*), first and second latches 88,90 extend from the bottom end 38 of the body 26. The latches 88,90 extend from the stop segments 51 of the body 26. Each latch 88,90 generally comprises a member extending outwardly from the stop segment, and includes a catch. As illustrated, the latches 88,90 are positioned generally 180 degrees apart, with the catches facing generally in the same direction.

The lamp/switch mount 32 includes a passage 92 through the main portion 62. The passage 92 accepts the latch 90 there through. A cut-out or recess 94 is provided in the periphery of the main portion 62 of the lamp/switch mount 32.

Referring to FIG. 3(*a*), the lamp/switch mount 32 is arranged to be mounted in abutting relationship to the stop segments 51 at the bottom end 38 of the body 26. The top surface of the main portion 62 of the lamp/switch mount 32 is abutted against the lower surface of the stop segments 51 of the body 26. In this position, the latch 90 extends through the passage 92 in the lamp/switch mount 32, with the catch of the latch 90 engaging the lower portion of the main portion 62 of the lamp/switch mount 32. At the same time, the latch 88 extends along the cut-out area 94 in the main portion 62 of the lamp/switch mount 32, with the catch thereof also engaging the lower portion of the main portion 62 of the lamp/switch mount 32.

Preferably, as illustrated in FIG. 3(*a*), the latches 88,90 are arranged to press the lamp/switch mount 32 both upwardly against the stop segments 51, and radially outwardly against the inside wall of the body 26 at its bottom end 38. Importantly, the latches 88,90 are slightly flexible, permitting a user to bend them out of engagement with the lamp/switch mount 32, thereby permitting the lamp/switch mount 32 to be removed from engagement with the body 26.

In one or more other embodiments, other means may be provided for removably securing the lamp/switch mount 32 to the body 26. Preferably, the securing means includes at least one member which is accessible by a user for manipulation in unlocking or removing the lamp/switch mount 32 from the body 26. There may be only a single latch or more than one latch. The latch(es) may engage the lamp/switch mount 32 in a variety of manners. For example, the lamp/switch mount 32 need not include passages or cutout areas. The lamp/switch mount 32 may include a trough in the lower surface or in a side surface for engagement by a portion (such as a catch) of the latch(es). In one embodiment, a threaded rod may extend from the body 26 and through a passage/slot in the lamp/switch mount 32. A nut may be threaded onto the rod to engage the lamp/switch mount 32 with the body 26.

In one embodiment, the latches 88,90 may extend form the wall forming the body 26 instead of or in addition to the stop segments 51. In another embodiment, rotating lock members may be associated with the body 26 and moved into a locking position when the lamp/switch mount 32 is pressed into engagement therewith, and rotated out of the locking position to permit removal/disconnection of the lamp/switch mount 32 from the body 26. In general, it is desired that a release for the locking mechanism be accessible to the user.

The various components of the push-button electrical switch 20 may be constructed from a wide range of materials. In one embodiment, the push-button lens cap 24, actuator 52, body 26, adapter 28, lock nut 30, and lamp/switch mount 32 comprise plastic or a similar material conveniently constructed in a molding or extrusion process. The contacts 72*a*,72*b* and spring 60 preferably comprise metal members. In one or more embodiments, the various components may have a variety of colors.

In one embodiment of the invention, at least a portion of the body 26 around the push-button lens cap 24 is arranged to illuminate or be illuminated. In this manner, the location of the push-button lens cap 24 may be easily identified by a user. In a preferred embodiment, the body 26 is constructed from a transparent or generally transparent material, such as clear plastic, instead of traditional black polypropylene. Light emitted by the lamp 70 passes through the body 26, thereby illuminating the body 26, including the peripheral portion thereof at the top end 36 around the push-button lens cap 24.

In one embodiment, to provide significant contrast between the push-button lens cap 24 and the body 26, the push-button lens cap 24 is arranged to generally not transmit light emitted by the lamp 70. In one embodiment, the push-button lens cap 24 may be constructed of an opaque material. In another embodiment, a shield, such as plastic plate, may be located within the push-button lens cap 24. In this embodiment, the push-button lens cap 24 is generally not illuminated, but the surrounding body 26 is, whereby the illuminated body 26 generally serves to identify the extent/location of the push-button lens cap 24. In a preferred embodiment, as illustrated in FIG. 2, a legend plate 96 is located inside of the push-button lens cap 24. The legend plate 96 may have lettering printed thereon which is readable through the push-button lens cap 24. For example, the legend plate 96 may be printed with "deal/draw," "bet one" or other words, numbers or symbols. In one embodiment, the legend plate 96 permits light illuminated by the lamp 70 to pass there through to render the lettering or other printing more visible. For example, the legend plate 96 may be a plastic plate of any of a variety of colors (even clear) having printing, such as black or other colored lettering.

In accordance with another aspect of the invention, the push-button electrical switch 20 is arranged to divert or ground electro-static discharge (ESD). In one or more embodiments of the invention, one or more of the components of the push-button electrical switch 20 are adapted to conduct electrical energy to the housing 22 of the gaming machine or other support structure or remote location, and away from the circuitry of the lamp 70 and electrical switch 34.

In one embodiment, as illustrated in FIG. 5, a path of electrical conduction P is defined from an external portion of the push-button electrical switch 20 to the housing 22 or other grounding element. In one or more embodiments, this pathway is defined by an electrically conductive material located in the push-button electrical switch 20. In one embodiment, The body 26, adapter 28, and/or lock nut 30 are constructed from plastic having a conductive carbon material 96 interspersed therein (see FIGS. 3A and 5). The interspersed conductive carbon 96 defines a pathway through the components the housing 22 or other ground. Preferably, sufficient conductive carbon is provided that the path of least resistance to the electrical energy is defined through the component to ground rather than through the component to the electrical switch 34 or lamp 70, and thereon to the associated circuitry.

It will be appreciated that in order 10 provide an effective pathway P to ground, the housing 22 or other supporting structure may need to be specially configured. In one embodiment, the housing 22 may comprise a metal panel which is painted (such as powder coated). In such an embodiment, it is preferred that an area of contact be provided between the body 26, adapter 28, lock nut 30 or other component of the push-button electrical switch 20 directly with the metal of the housing 22.

In one embodiment, a metal strip or the like may be connected to the push-button electrical switch 20, such as sandwiched between the adapter 28 and housing 22 or lock nut 30 and housing 22, with the metal strip extending to ground.

In another embodiment, the pathway P through the push-button electrical switch 20 to ground may comprise other than dispersed particles 96. In one embodiment, a wire may be embedded in the body 26 and extend from a top outer surface thereof to an contact with ground, such as the interface with the housing 22. Other interspersed materials may be used. An advantage of the interspersed material is that the location or proximity of the user's touch or approach to the push-button electrical switch 20 need not then coincide with a specific location of the path to ground (as in the case of an embedded wire), since multiple paths to ground are provided.

In other embodiments, a layer of conductive material may be located on the one or more components of the push-button electrical switch 20. For example, a thin layer of conductive metal may be deposited on the exterior of the body 26.

In one embodiment, the push-button lens cap 24 may be conductive. In such event, it is desired that the actuator 52 be insulating so that electrical energy is transferred from the push-button lens cap 24 through the body 26 to ground, and not to the switch/lamp circuits.

Assembly and use of the push-button electrical switch 20 of the invention will now be described. Referring to FIG. 2, the lamp 70 is installed into the lamp/switch mount 32 along with the contacts 72*a,b*. The electrical switch 34 is connected to the lamp/switch mount 32.

The push-button lens cap 24 is connected to the actuator 52. The spring 60 is inserted into the top end 36 of the body 26 and the actuator 52 is guided over the top end of the spring. The actuator 52 is pressed downwardly, compressing the spring 60 until the catches 56 of the legs 54*a*,54*c* of the actuator 52 engage the bottom end 38 of the body 26.

The lamp/switch mount 32 is then connected to the body 26. As described above, the lamp/switch mount 32 is aligned with the legs 54*a,b,c* and latches 88,90 and pressed upwardly. The legs 54*a,b,c* extend through the recesses 64*a,b,c* in the lamp/switch mount 32. The latch 90 extends through the passage 92, and the latch 88 extends along the cut-out 94. Upon further upward movement, the catches on the latches 88,90 extend over the bottom surface of the main portion 62 of the lamp/switch mount 32, locking it to the body 26.

The push-button electrical switch 20 may be conveniently mounted to the housing 22. First, the adapter 28 is extended over the bottom end 38 of the body 26 and moved upwardly as far as possible. Next, the bottom end 38 of the body 26 is passed through an aperture in the housing 22 until the adapter 28 rests upon or abuts the housing 22. The locking nut 30 is then engaged with the threads on the outer surface of the body 26 from the bottom end 38. The locking nut 30 is threaded upwardly until it engages the housing 22.

Appropriate wiring (not shown) is attached to the contacts 72*a*,72*b* for providing power to the lamp 70. Appropriate wiring (not shown) is also attached to the leads 86*a,b,c* of the electrical switch 34.

In use, a user depresses the push-button lens cap 24. The push-button lens cap 24 moves the actuator 52 downwardly against the force of the spring 60. Sufficient downward movement causes the foot 58 of the leg 54*b* to engage the switch button 84, actuating the electrical switch 34. Upon release of the user-applied pressure or force, the spring 60 moves the actuator 52 and push-button lens cap 24 upwardly.

A significant advantage of the push-button electrical switch 20 is that an electro-static discharge (ESD) from the player is routed away from the circuitry of the push-button electrical switch 20, avoiding many problems. In accordance with the invention, when a player touches (or comes sufficient close to the push-button electrical switch 20 that a discharge may arc through the air space and bridge to the switch) the push-button electrical switch 20, the discharged electrical energy is routed to the housing 22 or a remote location, grounding the discharge. In the preferred embodiment, the discharged is routed through the conductive material in the body 26, adapter 28 and/or lock nut 30 to the housing 22. This path routes the electrical energy away from the lamp circuit or the switch circuit.

In accordance with the invention, a push-button electrical switch 20 is provided which is simple to assemble and disassemble. In particular, replacement of the lamp 70 is facilitated. In the event the lamp 70 burns out and needs replacing, the lamp/switch mount 32 is easily disengaged from the body 26, providing access to the lamp 70 for replacement. In order to disengage the lamp/switch mount 32, a user need only bias the catches of the latches 88,90 out of engagement with the lamp/switch mount 32. Then, the user may move the lamp/switch mount 32 downwardly with respect to the body 26 for access to the lamp 70.

As another aspect of the invention, the push-button electrical switch 20 has an illuminated body 26 surrounding the user-actuatable push-button lens cap 24. The illuminated body 26 aids in defining to a user the location of the push-button lens cap 24.

It will be understood that the above described arrangements of apparatus and the method therefrom are merely illustrative of applications of the principles of this invention and many other embodiments and modifications may be made without departing from the spirit and scope of the invention as defined in the claims.

We claim:

1. A push-button actuatable electrical switch comprising:

a body having a first end and a second end and at least one stop extending into an interior area of said body between said first and second ends;

a first and a second latch extending outwardly from said at least one stop in a direction opposite said first end, said first and second latches spaced from one another and each including a catch extending from a free end thereof opposite a connection thereof to said at least one stop;

an actuator associated with said body;

a push-button mounted to said actuator and extending from said first end of said body;

a switch, said switch having a switch button for activating said switch; and a mount supporting a lamp and said switch, said mount including at least one surface for engagement by said first and second latch for connecting said mount to said body in position such that movement of said actuator with said push-button causes said switch button to be activated.

2. The push-button actuatable electrical switch in accordance with claim 1 wherein said mount includes at least one passage through which one of said latches extends.

3. The push-button actuatable electrical switch in accordance with claim 1 wherein mount includes a periphery having a notch therein and said mount including a passage therethrough, said first latch extending through said notch and said second latch extending through said passage when said mount is connected to said body.

4. The push-button electrical switch in accordance with claim 1 wherein the catch of said first and second latches extend in generally the same direction.

5. The push-button actuatable electrical switch in accordance with claim 1 wherein said mount includes a main portion having a top surface and a bottom surface, said top surface abutting said at least one stop when connected to said body and said first and second latches engaging said bottom surface.

* * * * *

UNITED STATES PATENT AND TRADEMARK OFFICE

CERTIFICATE OF CORRECTION

PATENT NO. : 6,590,176 B2 
DATED : July 8, 2003
INVENTOR(S) : Joseph W. Cole and Oliver C. Mou It is certified that error appears in the above-identified patent and that said Letters Patent is hereby corrected as shown below:

Title page,
Item [56], References Cited, U.S. PATENT DOCUMENTS, please change "4,590,342" to -- 5,490,342 --.

Drawings,
Sheet 1, Fig 1, please replace the reference numerals "84a, 84b and 84c" with -- 86a, 86b and 86c --.
Sheet 4, Fig. 5, please replace the reference numeral "84" with -- 86a --.

Column 5,
Line 6, please replace the word "Riot" with -- foot --.

Column 6,
Line 8, after the word "actuator", please insert the numeral -- 52 --.

Column 7,
Line 66, please replace the word "The" with -- the --.

Column 8,
Line 9, please replace the numeral "10" with -- to --.

Signed and Sealed this

Twenty-third Day of March, 2004

JON W. DUDAS
*Acting Director of the United States Patent and Trademark Office*